United States Patent [19]

Kojima et al.

[11] Patent Number: 5,060,617

[45] Date of Patent: Oct. 29, 1991

[54] FUEL SUPPLY SYSTEM FOR SELECTIVELY INCREASING THE FUEL SUPPLY TO AN ENGINE

[75] Inventors: Akinori Kojima, Hamamatsu; Norikazu Ishikawa; Yukio Ishida, both of Tokyo, all of Japan

[73] Assignees: Sanshin Kogyo Kabushiki Kaisha, Shizuoka; Nippon Carbureter Co., Tokyo, both of Japan

[21] Appl. No.: 574,757

[22] Filed: Aug. 30, 1990

[30] Foreign Application Priority Data

Aug. 30, 1989 [JP] Japan ..... 1-221634

[51] Int. Cl.[5] ..... F02D 41/06; F02D 41/10; F02D 41/04

[52] U.S. Cl. ..... 123/435; 123/179 G; 123/438

[58] Field of Search ..... 123/179 G, 435, 438, 123/510, 497

[56] References Cited

U.S. PATENT DOCUMENTS

| | | | |
|---|---|---|---|
| 4,312,314 | 1/1982 | McChesney et al. | 123/438 |
| 4,364,354 | 12/1982 | Kosuge et al. | 123/438 X |
| 4,554,896 | 11/1985 | Sougawa | 123/179 G |
| 4,577,604 | 3/1986 | Hara et al. | 123/497 |
| 4,644,919 | 2/1987 | Inoguchi et al. | 123/438 |
| 4,671,225 | 6/1987 | Dogadko | 123/187.5 R |
| 4,676,204 | 6/1987 | Inoguchi et al. | 123/438 X |
| 4,779,598 | 10/1988 | Billingsley et al. | 123/438 X |

FOREIGN PATENT DOCUMENTS

| | | | |
|---|---|---|---|
| 24627 | 2/1977 | Japan | 123/435 |
| 43026 | 4/1977 | Japan | 123/438 |
| 135348 | 8/1983 | Japan | 123/435 |
| 136551 | 8/1984 | Japan | 123/438 |
| 1-313661 | 12/1989 | Japan . | |

*Primary Examiner*—Tony M. Argenbright
*Attorney, Agent, or Firm*—Kenyon & Kenyon

[57] ABSTRACT

A fuel supply system for selectively increasing the fuel supply to an internal combustion engine suitable for use in outboard motors and the like in response to sensed operating conditions of the engine, such as engine start-up, engine acceleration, and engine knocking. A series of engine operating condition sensors, such as an engine temperature sensor, an engine throttle opening sensor, an engine crank angle sensor, and an engine knocking sensor, detects the occurrence of engine start-up, engine acceleration, or engine knocking and sends a signal to a micro-computer to operate an electromagnetic pump and electromagnetic control valve to supply an additional amount of fuel to the fuel supply passage of the engine.

16 Claims, 2 Drawing Sheets

FUEL SUPPLY SYSTEM FOR SELECTIVELY INCREASING THE FUEL SUPPLY TO AN ENGINE

BACKGROUND OF THE INVENTION

The invention relates in general to fuel supply systems for internal combustion engines suitable for use in outboard motors and the like and, more particularly, to a fuel supply system capable of supplying additional fuel both during start-up of the engine and during normal operation to promote acceleration or inhibit engine knocking.

Japanese Laid-Open Patent Application No. 1-313661 discloses an engine for outboard motors and the like provided with a fuel supply system, including a fuel supply increase pump and fuel supply increase control valves that facilitate engine starting by increasing the fuel supply. However, since this conventional system is deactivated by a timer control circuit after the engine has been started and a preset time period has elapsed, it is unable to provide an increased fuel supply for promoting engine acceleration or for preventing engine knocking during normal operation of the engine.

Thus, the invention is directed to the problem of providing an improved fuel supply increase system that is capable of supplying additional fuel not only during start-up of the engine, but also during normal operation to promote acceleration or inhibit engine knocking.

SUMMARY OF THE INVENTION

The invention solves this problem by providing a fuel supply system for selectively increasing the fuel supply to an internal combustion engine of an outboard motor or the like in response to predetermined operating conditions of the engine. The fuel supply system of the invention includes a fuel source, a fuel pump having an inlet communicating with the fuel source, an outlet for supplying fuel under pressure, a first pump section operable when the pump is turned on to supply fuel under pressure to the outlet, and a second pump section operable in response to an actuating signal to supply fuel under pressure to the outlet. A first fuel supply passage communicates with the pump outlet for receiving fuel under pressure from the fuel pump and conducting it to an internal combustion engine. A second fuel supply passage communicates with the pump outlet and the first fuel supply passage for conducting an additional amount of fuel to the first fuel supply passage. A control valve is disposed in the second fuel supply passage for selectively permitting the flow of fuel therethrough. A controller is operatively coupled to the second pump section and the control valve for selectively actuating the second pump section and the control valve in response to predetermined engine operating conditions. A series of engine operating condition sensors, including an engine temperature sensor, an engine throttle opening sensor, and an engine crank angle sensor, are operatively coupled to the controller for detecting engine start-up and engine acceleration. The controller actuates the second pump section and the control valve to supply an additional amount of fuel to the first fuel supply passage via the second fuel supply passage when either engine start-up or engine acceleration is detected by the sensors.

The engine operating condition sensors may further include an engine knocking sensor operatively coupled to the controller for sensing engine knocking. When this sensor is additionally provided, the controller actuates the second pump section of the fuel pump and the control valve to supply the additional amount of fuel when either engine start-up, engine acceleration, or engine knocking is detected by the sensors. The engine start-up condition is detected by the temperature sensor, the throttle opening sensor, and the crank angle sensor. Engine acceleration is detected by the throttle opening sensor and the crank angle sensor. Engine knocking is detected by the engine knocking sensor, the throttle opening sensor, and the crank angle sensor.

The first pump section may be a pulse pump and the second pump section may be an electromagnetic pump. The control valve may be an electromagnetic valve and the controller a micro-computer. The fuel source may include a fuel supply tank and a primary pump operatively connected between the supply tank and the fuel pump.

DETAILED DESCRIPTION

Figure 1:
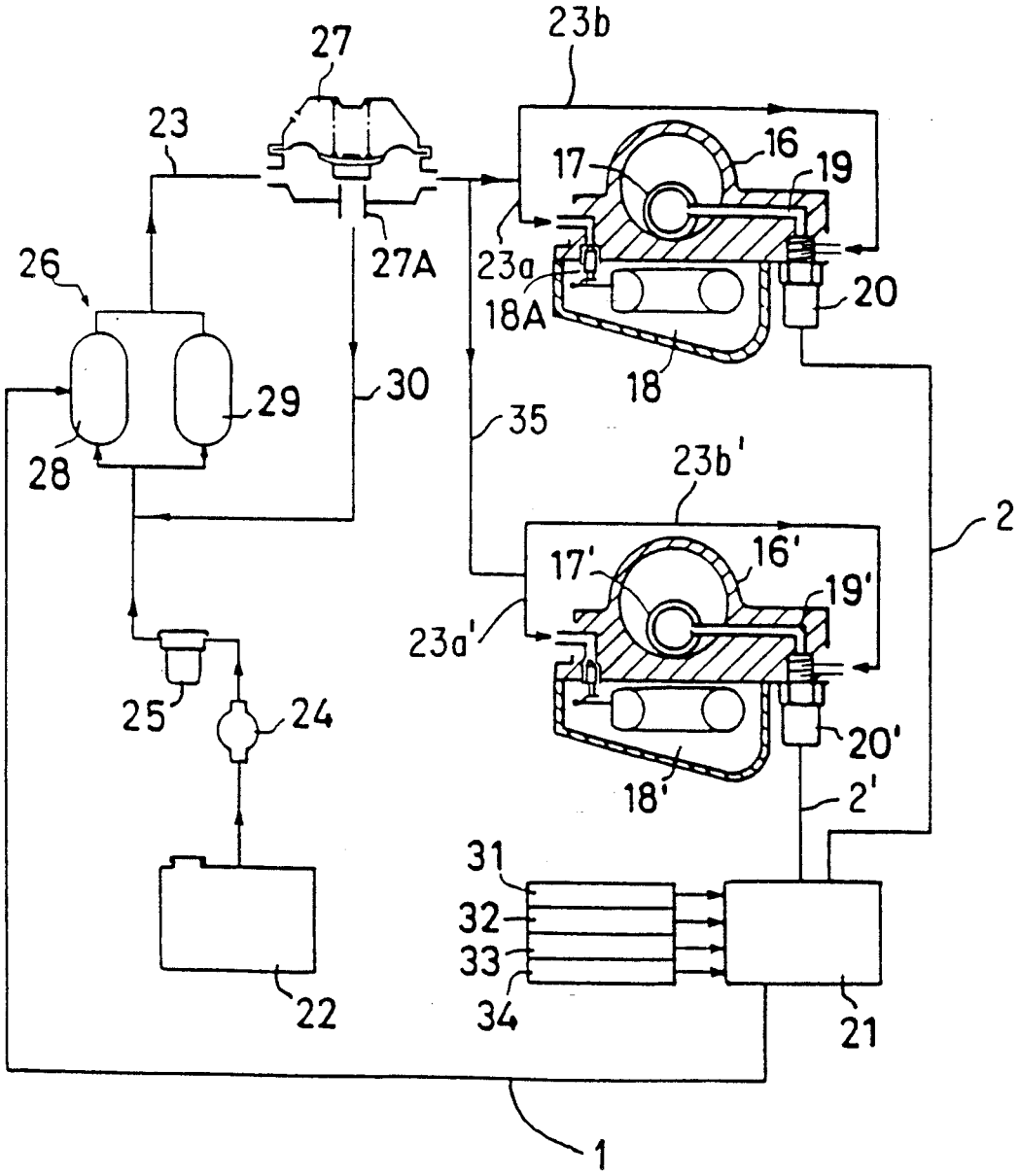
FIG. 1 is a schematic representation of a fuel supply system constructed according to the principles of the invention.
Figure 2:
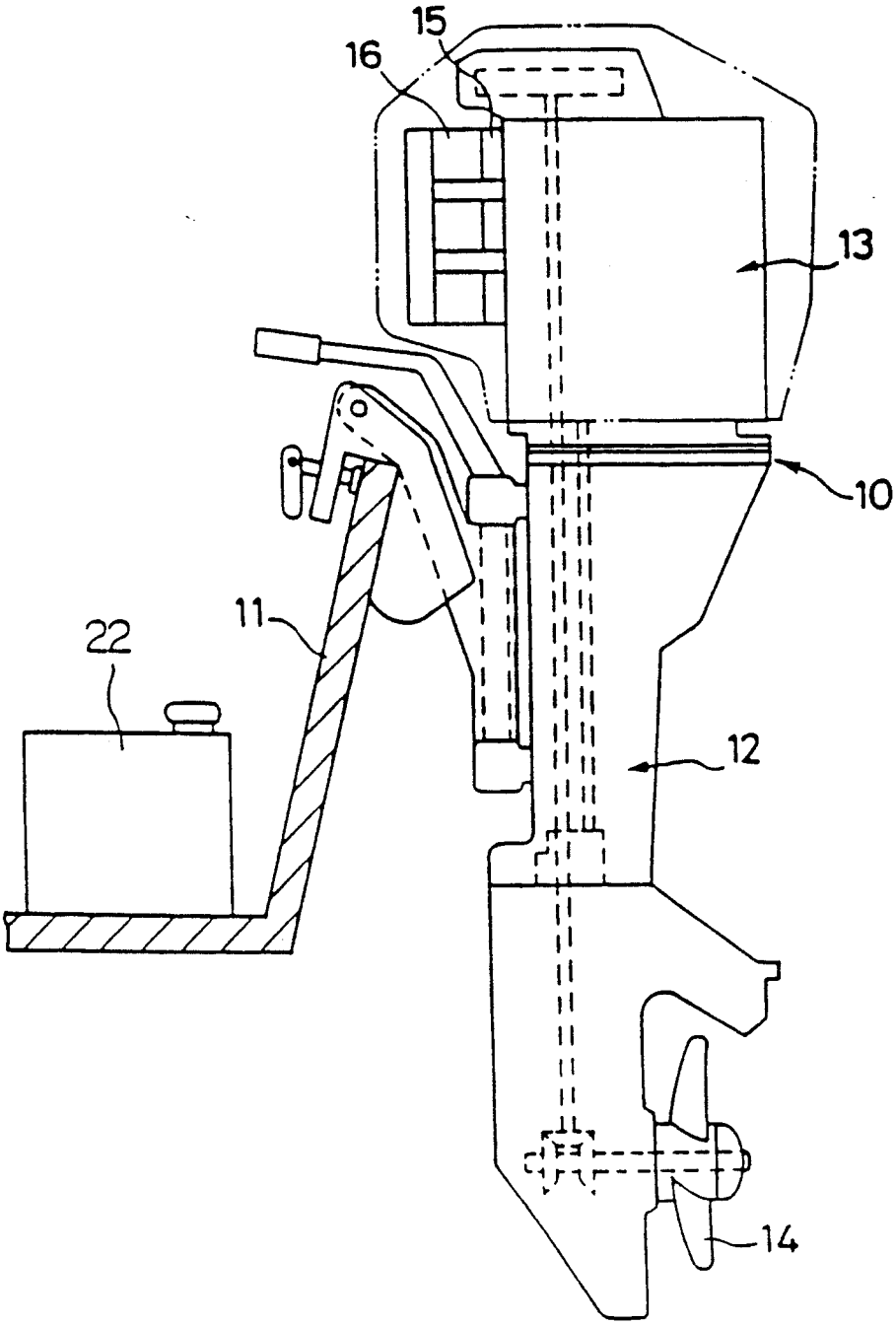
FIG. 2 is a side elevational view of an outboard motor having an engine that may be supplied with fuel by the fuel supply system of the invention.

The fuel supply system of the invention is schematically illustrated in FIG. 1 and may be used for supplying fuel to the internal combustion engine of an outboard motor or the like. FIG. 2 illustrates an outboard motor 10 having an internal combustion engine 13, which drives a propulsion unit 12 that includes a transmission and propeller 14. Engine 13 may be a two-cycle, six-cylinder, V-shaped engine having an intake manifold 15 and carburetor 16. Engine 13 is supplied with fuel by the fuel supply system of the invention, which includes a fuel supply tank 22.

Referring particularly to FIG. 1, the fuel supply tank 22 communicates with a conduit 23 that conducts fuel from tank 22 to the engine 13. A primary fuel pump 24 is arranged in the conduit 23 such that its inlet communicates with the tank 22. The outlet of primary pump 24 supplies fuel to the fuel filter 25 and fluid supply pump unit 26, respectively, which also are disposed in conduit 23.

Pump unit 26 includes a fuel supply pump 29, which may be a pulse pump, for supplying fuel to the engine 13 while the pump unit 26 is turned on and an additional fuel supply pump 28, which may be an electromagnetic pump, for supplying an additional amount of fuel to the engine in response to predetermined sensed conditions of the engine. Fuel is conducted from the electromagnetic pump 28 and pulse pump 29 of the fuel supply pump unit 26 via conduit 23 to a pressure regulator 27 disposed in conduit 23 downstream of pump unit 26.

Pressure regulator 27 operates in a conventional manner to maintain the pressure of the fuel in conduit 23 below a predetermined value. When the fuel pressure increases above the predetermined value, a flow passage 27A in regulator 27 is opened to conduct fuel to a conduit 30, which is connected to conduit 23 at a point upstream of fuel supply pump unit 26.

From regulator 27, conduit 23 splits into two sections **23*a*, 23*b* for supplying fuel to a fuel supply passage 17, which communicates with one or more cylinders of engine 13** in a conventional manner. For example, passage 17 may communicate with the three cylinders disposed on one side of the V-block of the six-cylinder engine 13. If passage 17 communicates with less than all of the cylinders of the engine, one or more branch lines 35 connected to conduit 23 may be provided for supplying fuel to an additional fuel supply passage 17', which communicates with the remaining cylinders, for example, the three cylinders on the other side of the V-block of the engine. As the fuel supply system for each set of commonly supplied cylinders is identical, only the system associated one passage, e.g., passage 17, is described herein.

Conduit 23*a* leads to a passage in carburetor 16 that includes a needle valve 18A. Valve 18A is controlled in a conventional manner known in the art by a float disposed in float chamber 18 for supplying fuel to passage 17 via an unillustrated passage in communication with float chamber 18 and fuel supply passage 17.

Conduit 23*b* communicates with an additional fuel supply passage 19, which, in turn, communicates with passage 17 for supplying an increased or additional amount of fuel to passage 17 in response to predetermined sensed conditions of the engine. A control valve 20, which may be an electromagnetic valve unit, is disposed in the additional fuel supply passage 19 for selectively permitting additional fuel to be supplied to fuel supply passage 17. Electromagnetic valve 20 and electromagnetic pump 28 are actuated by a controller 21, which may be a micro-computer, microprocessor, or the like, via control lines 1, 2, which supply operating signals to electromagnetic pump 28 and electromagnetic valve 20, respectively. Signals are supplied over lines 1, 2, to actuate pump 28 and open valve 20 in response to input signals fed to controller 21 by a series of sensors 31, 32, 33, and 34, which detected the occurrence of the predetermined operating conditions of the engine 13.

Sensor 31 is an engine temperature sensor that detects the temperatures of engine 13. Sensor 32 is an acceleration sensor that senses the degree of opening of the throttle of engine 13. Sensor 33 detects the crank angle of the engine and sensor 34 determines whether the engine 13 is knocking. The particular type of sensors that may be used to detect these operating conditions forms no part of the invention herein and any conventional sensor known in the art for detecting these conditions may be used.

The fuel supply system of the invention operates as follows. Pulse pump 29 of fuel pump supply unit 26 supplies fuel to fuel supply passage 17 via conduits 23, 23*a*, needle valve 18A, and float chamber 18 in the conventional manner to deliver fuel to the engine 13. When engine start-up, engine acceleration, or engine knocking is detected by the sensors, controller 21 actuates the electromagnetic pump 28 and opens the control valve 20 to conduct additional fuel to fuel supply passage 17 via additional fuel supply passage 19 to facilitate starting of the engine or engine acceleration, or to inhibit engine knocking. Additional fuel is supplied via passage 19 when any of the foregoing three engine operating conditions are detected by the sensors. The start-up condition of the engine is detected by the engine temperature sensor 31, throttle opening sensor 32, and crank angle sensor 33. The acceleration condition of engine after start-up is detected by throttle opening sensor 32 and crank angle sensor 33. The knocking condition of the engine is detected by knocking sensor 34, throttle opening sensor 32, and crank angle sensor 33.

What is claimed is:

1. A fuel supply system for selectively increasing the fuel supply to an internal combustion engine, said fuel supply system comprising:

(a) a source of fuel;

(b) a fuel pump having an inlet communicating with said fuel source, an outlet for supplying fuel under pressure, a first pump section operable when said pump is turned on to supply fuel under pressure to said outlet, and a second pump section operable in response to an actuating signal to supply fuel under pressure to said outlet;

(c) a first fuel supply passage communicating with said pump outlet for receiving fuel from said fuel pump and conducting it to an internal combustion engine;

(d) a second fuel supply passage communicating with said pump outlet and said first fuel supply passage for conducting an additional amount of fuel to said first fuel supply passage;

(e) a control valve disposed in said second fuel supply passage for selectively permitting fuel to flow therethrough;

(f) a controller operatively coupled to said second pump section and said control valve for selectively actuating said second pump section and said control valve in response to predetermined engine operating conditions; and (g) a series of engine operating condition sensors operatively coupled to said controller for detecting engine start-up and engine acceleration wherein said controller actuates said second pump section and said control valve to supply an additional amount of fuel to said first fuel supply passage via said second fuel supply passage when either engine start-up or engine acceleration is detected by said sensors.

2. The fuel supply system of claim 1, wherein said series of engine operating condition sensors include an engine temperature sensor, an engine throttle opening sensor, and a crank angle sensor.

3. The fuel supply system of claim 2, wherein said engine operating condition sensors further include an engine knocking sensor operatively coupled to said controller for sensing engine knocking wherein said controller actuates said second pump section and said control valve to supply said additional amount of fuel when either engine start-up, engine acceleration, or engine knocking is detected by the sensors.

4. The fuel supply system of claim 2, wherein engine start-up is detected by said engine temperature sensor, said engine throttle opening sensor, and said engine crank angle sensor.

5. The fuel supply system claim 4, wherein engine acceleration is detected by said engine throttle opening sensor and said engine crank angle sensor.

6. The fuel supply system of claim 3, wherein engine start-up is detected by said engine temperature sensor, said engine throttle opening sensor, and said engine crank angle sensor, engine acceleration is detected by said engine throttle opening sensor and said engine crank angle sensor, and engine knocking is detected by said engine knocking sensor, said engine throttle opening sensor, and said engine crank angle sensor.

7. The fuel supply system of claim 6, wherein said first pump section is a pulse pump, said second pump section is an electromagnetic pump, said control valve is an electromagnetic valve, and said controller is a micro-computer.

8. The fuel supply system of claim 7, wherein said fuel source comprises a fuel supply tank.

9. The fuel supply system of claim 8, wherein said fuel source further comprises a primary fuel pump operatively connected between said fuel supply tank and said fuel pump unit.

10. The fuel supply system of claim 9, further comprising a fuel filter disposed between said primary fuel pump and said fuel pump unit, and a pressure regulator disposed downstream of said fuel pump unit and upstream of said first and second fuel supply passages.

11. The fuel supply system of claim 1, wherein the internal combustion engine is operatively coupled to an outboard motor.

12. A fuel supply system for selectively increasing the fuel supply to internal combustion engine, said fuel supply system comprising:

(a) a source of fuel;

(b) a fuel pump having an inlet communicating with said fuel source, an outlet for supplying fuel under pressure, a first pump section operable when said pump is turned on to supply fuel under pressure to said outlet, and a second pump section operable in response to an actuating signal to supply fuel under pressure to said outlet;

(c) a first fuel supply passage communicating with said pump outlet for receiving fuel under pressure from said fuel pump and conducting it to an internal combustion engine;

(d) a second fuel supply passage communicating with said pump outlet and said first fuel supply passage for conducting an additional amount of fuel to first fuel supply passage;

(e) a control valve disposed in said second fuel supply passage for selectively permitting fuel to flow therethrough; and (f) means for selectively actuating said second pump section and said control valve to supply an additional amount of fuel to said first fuel supply passage via said second fuel supply passage in response to detection of a predetermined engine operating condition of either engine start-up or engine acceleration.

13. The fuel supply system of claim 10, wherein said selective actuation means additionally actuates said second pump section and said control valve to supply an additional amount of fuel in response to engine knocking.

14. The fuel supply system of claim 13, wherein said selective actuation means includes a micro-computer and a series of engine operating condition sensors.

15. The fuel supply system of claim 14, wherein said series of engine operating condition sensors include an engine temperature sensor, an engine throttle opening sensor, and a crank angle sensor.

16. The fuel supply system of claim 12, wherein the internal combustion engine is operatively coupled to an outboard motor.

* * * * *

UNITED STATES PATENT AND TRADEMARK OFFICE

CERTIFICATE OF CORRECTION

PATENT NO. : 5,060,617

DATED : October 29, 1991

INVENTOR(S) : Akinori Kojima, et al

It is certified that error appears in the above-identified patent and that said Letters Patent is hereby corrected as shown below:

Column 6 Line 17, Change "claim 10" to --claim 12--.

Signed and Sealed this

Fourth Day of May, 1993

*Attest:*

Michael K. Kirk

MICHAEL K. KIRK

*Attesting Officer*

*Acting Commissioner of Patents and Trademarks*